US009156248B1

(12) United States Patent
Thayer

(10) Patent No.: US 9,156,248 B1
(45) Date of Patent: Oct. 13, 2015

(54) SYSTEMS AND METHODS FOR IMPLEMENTING A RELEASE FILM FOR A CLEANING UNIT IN AN IMAGE FORMING DEVICE USING DIGITAL OFFSET LITHOGRAPHIC PRINTING TECHNIQUES

(71) Applicant: XEROX Corporation, Norwalk, CT (US)

(72) Inventor: Bruce Earl Thayer, Spencerport, NY (US)

(73) Assignee: Xerox Corporation, Norwalk, CT (US)

( * ) Notice: Subject to any disclaimer, the term of this patent is extended or adjusted under 35 U.S.C. 154(b) by 7 days.

(21) Appl. No.: 14/266,498

(22) Filed: Apr. 30, 2014

(51) Int. Cl.

| | |
|---|---|
| ***B41F 35/00*** | (2006.01) |
| ***B41F 35/02*** | (2006.01) |
| ***B41F 35/04*** | (2006.01) |
| *B41F 35/06* | (2006.01) |
| *B41L 25/00* | (2006.01) |

(52) U.S. Cl.
CPC ..... *B41F 35/04* (2013.01); *B41F 35/00* (2013.01); *B41F 35/02* (2013.01); *B41F 35/06* (2013.01); *B41L 25/00* (2013.01)

(58) Field of Classification Search
CPC ..... B41F 35/00; B41F 35/02; B41F 35/04; B41F 35/06
See application file for complete search history.

(56) References Cited

U.S. PATENT DOCUMENTS

| | | | | |
|---|---|---|---|---|
| 6,865,986 | B2 * | 3/2005 | Link | 101/424 |
| 7,017,488 | B2 * | 3/2006 | Ruschkowski | 101/425 |
| 2001/0047561 | A1 * | 12/2001 | Hara et al. | 15/256.51 |
| 2003/0075065 | A1 * | 4/2003 | Loos et al. | 101/425 |
| 2004/0250836 | A1 * | 12/2004 | Koppelkamm et al. | 134/6 |
| 2010/0269274 | A1 * | 10/2010 | Steckmann et al. | 15/4 |
| 2012/0103212 | A1 * | 5/2012 | Stowe et al. | 101/147 |
| 2012/0103213 | A1 * | 5/2012 | Stowe et al. | 101/148 |
| 2012/0103214 | A1 * | 5/2012 | Stowe et al. | 101/363 |
| 2012/0103217 | A1 * | 5/2012 | Stowe et al. | 101/423 |
| 2012/0103219 | A1 * | 5/2012 | Stowe et al. | 101/450.1 |
| 2012/0274914 | A1 * | 11/2012 | Stowe et al. | 355/53 |
| 2015/0083162 | A1 * | 3/2015 | Kylling et al. | 134/6 |

* cited by examiner

*Primary Examiner* — David Banh
(74) *Attorney, Agent, or Firm* — Ronald E. Prass, Jr.; Prass LLP

(57) ABSTRACT

A system and method are provided for depositing a release layer/film on a cleaner roller in an image forming device to facilitate effective cleaning of a reimageable surface in an image forming device using a proposed variable data digital lithographic image forming architecture. A borax or other solute solution is deposited on a surface of a cleaner roller and an air knife is used to evaporate a liquid component of the solution causing the liquid to come off and a thin-film of borax or other solute to remain on the surface of the cleaner roller. The thin film layer is then dry at a point of contact with the reimageable surface to recover residual ink from the reimageable surface with the surface of the cleaner roller on top of the thin film layer. The thin film layer is re-wetted to support efficient transfer of the ink to a web.

9 Claims, 3 Drawing Sheets

SYSTEMS AND METHODS FOR IMPLEMENTING A RELEASE FILM FOR A CLEANING UNIT IN AN IMAGE FORMING DEVICE USING DIGITAL OFFSET LITHOGRAPHIC PRINTING TECHNIQUES

BACKGROUND

1. Field of Disclosed Subject Matter

This disclosure relates to systems and methods for providing a release layer/film on a cleaner roller to facilitate more effective cleaning of a reimageable surface in an image forming device using a proposed variable data digital lithographic image forming architecture.

2. Related Art

U.S. Patent Application Publication No. 2012/0103212 A1 (the 212 Publication) published May 3, 2012, and based on U.S. patent application Ser. No. 13/095,714, which is commonly assigned, and the disclosure of which is incorporated by reference herein in its entirety, proposes systems and methods for providing variable data lithographic and offset lithographic printing or image receiving medium marking in image forming system. The systems and methods disclosed in the 212 Publication are directed to improvements on various aspects of previously-attempted variable data imaging lithographic marking concepts to achieve effective truly variable digital data lithographic printing.

According to the 212 Publication, a reimageable surface is provided on an imaging member, which may be a drum, plate, belt or the like. The reimageable surface may be composed of, for example, a class of materials commonly referred to as silicones, including polydimethylsiloxane (PDMS) among others. The reimageable surface may be formed of a relatively thin layer over a mounting layer, a thickness of the relatively thin layer being selected to balance printing or marking performance, durability and manufacturability.

The 212 Publication describes, in requisite detail, an exemplary variable data lithography system 100 such as that shown, for example, in FIG. 1. A general description of the exemplary system 100 shown in FIG. 1 is provided here. Additional details regarding individual components and/or subsystems shown in the exemplary system 100 of FIG. 1 may be found in the 212 Publication.

As shown in FIG. 1, the exemplary system 100 may include an imaging member 110. The imaging member 110 in the embodiment shown in FIG. 1 is a drum, but this exemplary depiction should not be read in a manner that precludes the imaging member 110 being a plate or a belt, or of another known configuration. The imaging member 110 is used to apply an inked image to an image receiving media substrate 114 at a transfer nip 112. The transfer nip 112 is produced by an impression roller 118, as part of an image transfer mechanism 160, exerting pressure in the direction of the imaging member 110. The exemplary system 100 may be used for producing images on a wide variety of image receiving media substrates 114. The 212 Publication also explains the wide latitude of marking (printing) materials that may be used, including marking materials with pigment densities greater than 10% by weight. As does the 212 Publication, this disclosure will use the term ink to refer to a broad range of printing or marking materials to include those which are commonly understood to be inks, pigments, and other materials which may be applied by the exemplary system 100 to produce an output image on the image receiving media substrate 114.

The 212 Publication depicts and describes details of the imaging member 110 including the imaging member 110 being comprised of a reimageable surface layer formed over a structural mounting layer that may be, for example, a cylindrical core, or one or more structural layers over a cylindrical core.

The exemplary system 100 includes a dampening solution subsystem 120 generally comprising a series of rollers, which may be considered as dampening rollers or a dampening unit, for uniformly wetting the reimageable surface of the imaging member 110 with a dampening solution. A purpose of the dampening solution subsystem 120 is to deliver a layer of dampening solution, generally having a uniform and controlled thickness, to the reimageable surface of the imaging member 110. As described in the 212 Publication, the dampening solution may be composed of a fountain solution generally comprising water optionally with small amounts of isopropyl alcohol (IPA) or ethanol added to reduce surface tension, as well as to lower evaporation energy necessary to support subsequent laser patterning, as will be described in greater detail below. Small amounts of certain surfactants may be added to the dampening solution as well to adjust the inking and transfer properties of the reimageable surface of the imaging member 110. Experiments continue to determine an optimal release layer dampening solution.

Once the dampening solution is metered onto the reimageable surface of the imaging member 110, a thickness of the dampening solution may be measured using a sensor 125 that may provide feedback to control the metering of the dampening solution onto the reimageable surface of the imaging member 110 by the dampening solution subsystem 120.

Once a precise and uniform amount of dampening solution is provided on the reimageable surface of the imaging member 110, an optical patterning subsystem 130 may be used to selectively form a latent image in the uniform dampening solution layer by image-wise patterning the dampening solution layer using, for example, laser energy. The reimageable surface of the imaging member 110 should ideally absorb most of the laser energy emitted from the optical patterning subsystem 130 close to the surface to minimize energy wasted in heating the structural mounting layer and to minimize lateral spreading of heat in order to maintain a high spatial resolution capability. Alternatively, an appropriate radiation sensitive component may be added to the dampening solution to aid in the absorption of the incident radiant laser energy. While the optical patterning subsystem 130 is described above as being a laser emitter, it should be understood that a variety of different systems may be used to deliver the optical energy to pattern the dampening solution.

The mechanics at work in the patterning process undertaken by the optical patterning subsystem 130 of the exemplary system 100 are described in detail with reference to FIG. 5 in the 212 Publication. Briefly, the application of optical patterning energy from the optical patterning subsystem 130 results in selective evaporation of portions of the layer of dampening solution.

Following patterning of the dampening solution layer by the optical patterning subsystem 130, the patterned layer over the reimageable surface of the imaging member 110 is presented to an inker subsystem 140. The inker subsystem 140 is used to apply a uniform layer of ink over the layer of dampening solution and the reimageable surface layer of the imaging member 110. The inker subsystem 140 may use an anilox roller to meter an ink onto one or more ink forming rollers that are in contact with the reimageable surface layer of the imaging member 110. Separately, the inker subsystem 140 may include other traditional elements such as a series of metering rollers to provide a precise feed rate of ink to the reimageable surface. The inker subsystem 140 may deposit the ink to the pockets representing the imaged portions of the reimageable surface, while ink deposited on the unformatted portions of the dampening solution will not adhere based on the hydrophobic and/or oleophobic nature of those portions.

A cohesiveness and viscosity of the ink residing in the reimageable layer of the imaging member 110 may be modified by a number of mechanisms. One such mechanism may involve the use of a rheology (complex viscoelastic modulus) control subsystem 150. The rheology control system 150 may form a partial crosslinking core of the ink on the reimageable surface to, for example, increase ink cohesive strength relative to the reimageable surface layer. Curing mechanisms may include optical or photo curing, heat curing, drying, or various forms of chemical curing. Cooling may be used to modify rheology as well via multiple physical cooling mechanisms, as well as via chemical cooling.

The ink is then transferred from the reimageable surface of the imaging member 110 to a substrate of image receiving medium 114 using a transfer subsystem 160. The transfer occurs as the substrate 114 is passed through a transfer nip 112 between the imaging member 110 and an impression roller 118 such that the ink within the voids of the reimageable surface of the imaging member 110 is brought into physical contact with the substrate 114. With the adhesion of the ink having been modified by the rheology control system 150, modified adhesion of the ink causes the ink to adhere to the substrate 114 and to separate from the reimageable surface of the imaging member 110. Careful control of the temperature and pressure conditions at the transfer nip 112 may allow transfer efficiencies for the ink from the reimageable surface of the imaging member 110 to the substrate 114 to exceed 95%. While it is possible that some dampening solution may also wet substrate 114, the volume of such a dampening solution will be minimal, and will rapidly evaporate or be absorbed by the substrate 114.

In certain offset lithographic systems, it should be recognized that an offset roller, not shown in FIG. 1, may first receive the inked image pattern and then transfer the inked image pattern to a substrate according to a known indirect transfer method using an offset roller, or other device, as an intermediate transfer body.

Following the transfer of the majority (95+%) of the ink to the substrate 114 at the transfer nip 112, any residual ink and/or residual dampening solution must be removed from the reimageable surface of the imaging member 110 to prepare the reimageable surface to repeat the digital image forming operation without "ghosting." This removal is most preferably undertaken without scraping or wearing the reimageable surface of the imaging member 110. An air knife or other like non-contact device may be employed to remove residual products. It is anticipated, however, that some amount of ink residue may remain. Removal of such remaining ink residue may be accomplished through use of some form of active cleaning subsystem 170. The 212 Publication describes details of such a cleaning subsystem 170 including at least a first cleaning member such as a sticky or tacky member in physical contact with the reimageable surface of the imaging member 110, the sticky or tacky member removing residual ink and any remaining small amounts of surfactant compounds of the dampening solution from the reimageable surface of the imaging member 110. The sticky or tacky member may then be brought into contact with a smooth roller to which the residual ink and other products may be transferred from the sticky or tacky member, the ink and other products being subsequently stripped from the smooth roller by, for example, a doctor blade or other like device and collected as waste.

The 212 Publication details other mechanisms by which cleaning of the reimageable surface of the imaging member 110 may be facilitated. Regardless of the cleaning mechanism, however, cleaning of the residual ink and dampening solution from the reimageable surface of the imaging member 110 is essential to preventing ghosting in subsequent image forming operations as the images change. Once cleaned, the reimageable surface of the imaging member 110 is again presented to the dampening solution subsystem 120 by which a fresh layer of dampening solution is supplied to the reimageable surface of the imaging member 110, and the process is repeated.

SUMMARY OF DISCLOSED EMBODIMENTS

According to the above proposed structure, variable data digital lithography systems have attracted attention in producing truly variable digital images in a lithographic image forming system. The above-described architecture combines the functions of the imaging plate and potentially a transfer blanket into a single imaging member 110.

Experimentation continues to improve and optimize individual components in the variable data digital lithographic image forming system, including such aspects as a composition of the reimageable surface, a composition of the inks and a configuration of the cleaning system.

Since the filing of the application that published as the 212 Publication, an alternative configuration for at least the cleaning system has emerged. The currently-proposed cleaning system uses a smooth, high surface energy cleaner roller to contact the reimageable surface of the imaging member to clean residual ink that did not transfer to print media from the reimageable surface. The materials for the surfaces of the cleaner rollers experimentally include chrome-coated steel rollers, glass-coated rollers, and the like, all providing a hard, smooth, high surface energy surface that will cause the residual ink that remains on the reimageable surface to be transferred to the cleaner roller.

The residual ink is then removed from the surface of the cleaner roller by a cleaning web moistened with a cleaning fluid. Typically, a polyester web may be used as the cleaning web to remove the residual products from the cleaner roller for disposal. The non-woven cleaning web rubs against the cleaner roller wiping the residual ink off of the cleaner roller. In conventional lithographic systems, cleaning webs were typically soaked with some manner of cleaning solvent. These conventional cleaning webs were used to clean the lithographic plates and blanket rolls. The cleaning operations in conventional lithographic systems typically took place when the conventional lithographic printing system was not running. The components were typically cleaned between imaging operations, including in a particular cleaning operation that may require that the image forming device to be off-line for an extended period of time.

In the variable data digital lithographic image forming process, there is a requirement for the cleaning processes to be continuous with, for example, the cleaning web potentially being indexed to provide generally continual cleaning of the cleaner roller as it lifts residual ink from the reimageable surface on each pass. The cleaning web is typically fed clean from a supply roller and recovered dirty by a used web roller acting as a take-up.

A number of fluids have been tried to facilitate the continual wetted cleaning process undertaken by cleaning web interaction with the cleaner roller. Water has emerged as a candidate fluid based on its low cost and its environmentally benign nature. Isopropyl alcohol (IPA), for example, tends to work better than water. The difficulty is that IPA presents certain environmental concerns. The cleaning fluid must be evaporated from the cleaner roller surface prior to the cleaner roller again entering the cleaning nip formed between the cleaner roller and the reimageable surface of the imaging member for another cleaning pass. The cleaning fluid is currently being evaporated through conventional evaporative processes including through the use of, for example, an air knife. The use of any cleaning fluid other than water complicates this process with, for example, a need to filter the atmosphere into which the other fluids may be evaporated.

Unfortunately, it has been shown that water may not effectively clean ink from all potential cleaner roller materials, including cleaning the residual ink from mylar or aluminum surfaces. The cleaner roller surface, it has been determined, should optimally be mirror smooth. This requires great care in preparing the surface of the cleaner roller, e.g., super-finishing the surface, and requires a hard material that can be successfully smoothed and that will resist scratching after it has been fabricated and when in extended use. Because the variable data digital lithographic image forming process is intended for production printers, e.g., label presses, long life, reliability and good print quality are essential for low run cost and customer acceptance and/or satisfaction. The variable data digital lithography image forming system cleaner unit with a web and cleaning fluid would require that the cleaner roller be periodically replaced due to fine scratches accumulated in the course of normal operation. An effectiveness of cleaning with water and solvent can be improved by applying significant pressure between the web and the surface of the cleaner roller when only water is used as the solvent. This "solution," however, presents certain attendant shortfalls in, for example, reducing a service life of certain of the components, including potentially the cleaner roller, and decreasing a latitude of materials from which the cleaning web may be formed based on a requirement for an application of additional force to and via the web.

In view of the above conditions, it would be advantageous to find some manner by which to enhance the cleaning operation of a cleaner roller while maintaining use of an environmentally benign solvent.

Exemplary embodiments of the systems and methods according to this disclosure may provide for the depositing and evaporating a release layer solvent on a surface of a cleaner roller leaving a solid component of the release layer solvent in a dry form that could be reactivated on a next cycle to support enhanced removal of collected residual materials from the cleaner roller.

Exemplary embodiments may provide a type of release layer on a surface of the cleaner roller upon which residual ink and dampening solution may sit upon recovery. In embodiments, that release layer on the surface of the cleaner roller may be reactivated through, for example, the addition of water to enhance release of the residual products from the surface of the cleaner roller.

In exemplary embodiments, for example, a borax solution may be deposited on a clean surface of the cleaner roller, and an air knife may be used to evaporate the liquid component of the borax solution causing the water to come off and a thin-film of borax to remain on the surface of the cleaner roller. The thin-film of borax may then be dry at a point of contact with the reimageable surface to recover the residual ink and fountain solution from the reimageable surface of the imaging member. The residual ink on the reimageable surface may transfer to the surface of the cleaner roller on top of the borax layer. As the surface of the cleaner roller contacts the wetted web, the borax layer may be re-wetted in a manner that supports efficient transfer of the residual products to the web. The web then recovers all of the residual products in an easier manner, exerting less pressure, than it would from a non-coated cleaner roller surface.

Exemplary embodiments may provide a low enough tension of the web with regard to the cleaner roller that the cleaner roller may not need to be self-powered, as is currently the proposal, i.e., the cleaner roller may be powered only by interaction with the reimageable surface of the imaging member. A water-only system would require too high a tension on the cleaning web to facilitate this objective. Accomplishment of this objective may result in less wear on the reimageable surface as movement of a non-driven cleaner roller may not need to be synchronized to movement of the reimageable surface.

Exemplary embodiments may increase a latitude for system designers to select materials for the cleaning web as pressure on the cleaning web may be lowered. The cleaning web optimally may tend to be of a very thin composition, and thus easily tearable. As a result, any manner by which a web load can be reduced for the cleaning web will produce potential additional beneficial results.

Exemplary embodiments may replace a conventional cleaning web with, for example, a web or sponge wrapped roller for contacting the cleaner roller to undertake the cleaning and wetting/re-wetting of the cleaner roller surface.

These and other features, and advantages, of the disclosed systems and methods are described in, or apparent from, the following detailed description of various exemplary embodiments.

BRIEF DESCRIPTION OF THE DRAWINGS

Various exemplary embodiments of the disclosed systems and methods for providing a release layer/film on a cleaner roller in an image forming device to facilitate more effective cleaning of a reimageable surface in an image forming device using a proposed variable data digital lithographic image forming architecture will be described, in detail, with reference to the following drawings, in which.

DETAILED DESCRIPTION OF THE DISCLOSED EMBODIMENTS

Figure 1:
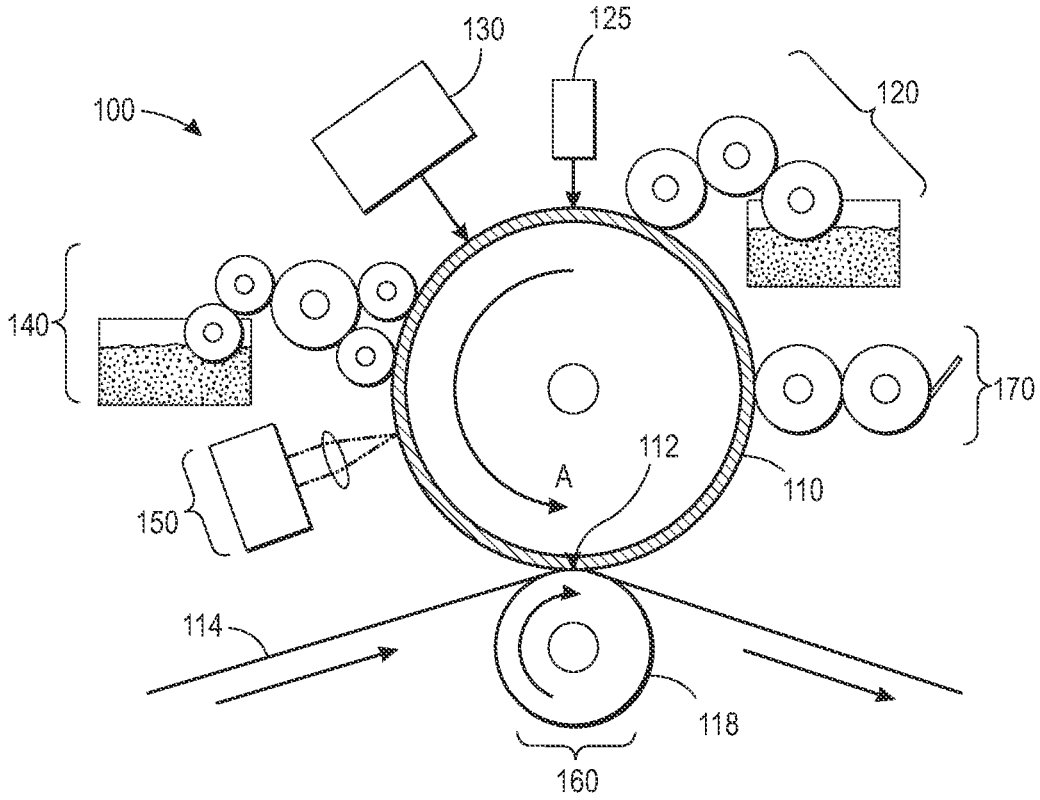
FIG. 1 RELATED ART
FIG. 1 illustrates a schematic representation of a proposed variable data digital lithographic image forming system.

The systems and methods for providing a release layer/film on a cleaner roller in an image forming device to facilitate more effective cleaning of a reimageable surface in an image forming device using a proposed variable data digital lithographic image forming architecture according to this disclosure will generally refer to this specific utility or function for those systems and methods. Exemplary embodiments described and depicted in this disclosure should not be interpreted as being specifically limited to any particular configuration of the described cleaning unit. Any advantageous adaptation of a digital image forming process that may benefit from implementation of a unique release layer cleaning process is contemplated as being included in this disclosure.

Specific reference to, for example, lithographic printing techniques, and to the proposed variable data digital lithographic image forming device should not be considered as being limited to any particular configuration of the techniques or devices, as described. The terms "image forming device," "lithographic printing device/system" and the like, as referenced throughout this disclosure are intended to refer globally to a class of devices and systems that carry out what are generally understood as lithographic marking functions as those functions would be familiar to those of skill in the art. Additionally, while references will generally be made to individual cleaning unit components, these references are intended to be exemplary only and not limiting to the disclosed subject matter.

Exemplary embodiments propose a release film being applied to a surface of a cleaner roller in a variable data digital lithographic image forming system. The release film may be applied by a cleaning web, a sponge-surface cleaning roller, or other like component, moistened with a cleaning solution, to the surface of the cleaner roller. The solvent of the cleaning solution would be evaporated after the cleaning nip formed between the cleaning web or sponge cleaning component and the surface of the cleaner roller, leaving the solute as a thin release film on the cleaner roller surface. Ink would be cleaned from the reimageable surface of the imaging member by transferring from the reimageable surface to the release film on the cleaner roller. As the cleaner roller enters the cleaning web nip, the cleaning solution in the cleaning web or sponge migrates under the ink layer on the cleaner roller and substantially dissolves the release layer. This substantial dissolution of the release layer on the surface of the cleaner roller reduces adhesion of the ink layer to the cleaner roller and makes cleaning easier. The release film enables cleaning of difficult to clean materials, roughened surfaces and cleaning at lower pressures. The cleaning solution moistened cleaning web or sponge simultaneously cleans ink and applies a fresh coating of the release film.

Experimental testing has been undertaken with a range of solutes to demonstrate improved cleaning on stress substrates (materials that would not clean with water alone). These tests have shown that the pressure required to clean with the deposition of a release film is lower than without the inclusion of a release film. These tests have further shown that the adhesion between collected residual inks and the release film is equivalent to adhesion between the collected residual inks and the substrate surface of the cleaner roller, i.e., ink transfer from the reimageable surface to the release film is equivalent to transfer to the bare cleaner roll and good cleaning of the reimageable surface is maintained with the release film. These tests have aided in identifying a minimal amount of cleaning solution required for increasingly effective cleaning and that over saturating the cleaning web with cleaning solution does not impact cleaning. Additional tests have been used to estimate the ink holding capacity of the cleaning web. These tests have demonstrated that a heavier application of cleaning solution creates a release film that enables cleaning on rough surfaces.

Figure 2:
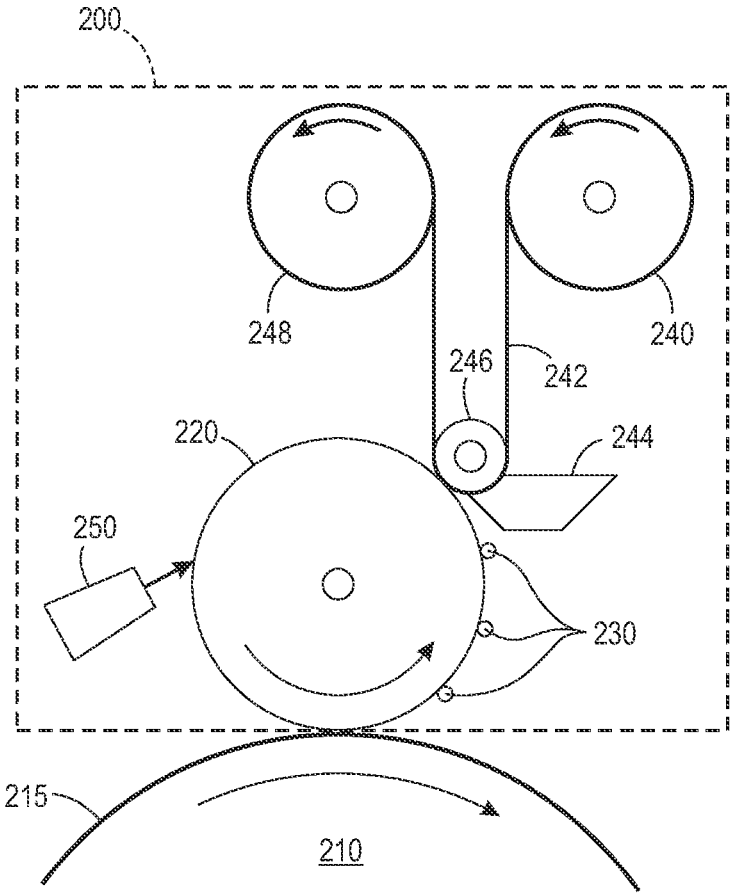
FIG. 2 illustrates a schematic representation of an exemplary embodiment of an improved cleaning unit for use in a variable data digital lithographic image forming system according to this disclosure.

FIG. 2 illustrates a schematic representation of an exemplary embodiment of an improved cleaning unit 200 for use in a variable data digital lithographic image forming system according to this disclosure. Comparing the orientations of the depiction of the cleaning system in FIG. 2 and the depiction of the cleaning unit component 170 in FIG. 1 will inform those of skill in the art that no particular orientation of the particular cleaning elements should be implied from these depictions.

The exemplary improved cleaning unit 200 includes a hard-surfaced cleaner roller 220 that may be brought into contact with a reimageable surface 215 of an imaging unit 210, in the manner described in detail above, to remove residual product components, including at least residual ink 230, from the reimageable surface 215. In this manner, at least the residual ink 230 is cleaned from the reimageable surface 215 by the cleaner roller 220 coated with a release film in a manner that will be described in greater detail below.

The exemplary improved cleaning unit 200 includes a cleaning web system. It should be noted, however, as indicated above, that the cleaning web system may be replaceable, in embodiments, with a sponge-surfaced roller or other like component for cleaning the surface of the cleaner roller and for depositing a layer of cleaning solvent on the surface of the cleaner roller. The cleaning web system, in turn, includes a supply roller 240 supplying cleaning web 242 threaded around a web backer roller 246 and taken up by a used web roller 248. The web backer roller 246 may be usable to apply moderate pressure of the cleaning web 242 to the cleaner roller 220 to facilitate the cleaning of the residual products including the residual ink 230 from the surface of the cleaner roller 220. At an appropriate point in the travel of the cleaning web 242 between the supply roller 240 and the web backer roller 246, the improved cleaning unit 200 passes the cleaning web 242 through a cleaning solvent application component 244. The cleaning solvent application component 244 is usable to wet the cleaning web 242 with a cleaning solution or solvent.

The wetted cleaning web 242 may be usable to clean the residual product components, including at least the residual ink 230 from the surface of the cleaner roller 220. The wetted cleaning web 242 may also be usable to deposit a layer of the cleaning solution or solvent on to the surface of the cleaner roller 220. The cleaning solution or solvent includes a liquid solvent component and a solid solvent component suspended in the liquid solvent component. An air knife 250 may be usable to evaporate the liquid solvent component from the cleaning solution or solvent, leaving the solid solvent component (the solute) disposed on the surface of the cleaner roller 220 as a release film.

On a next pass of any portion of the surface of the cleaner roller 220 through the cleaner roller/cleaning web nip, the cleaning solution or solvent in the cleaning web 242 moistens the dry release film on the surface of the cleaner roller 220 between the cleaner roller 220 and the recovered residual products, including the residual ink 230. This wetting of the dry release film on the surface of the cleaner roller 220 reduces adhesion of the recovered residual products, including the residual ink 230 to the surface of the cleaner roller 220, and enables removal of the recovered residual products, including the residual ink 230 with lower nip pressures than without a presence of the release layer on the surface of the cleaner roller 220.

In experiments, use of a release layer in the manner disclosed has been demonstrated to clean the recovered residual products, including the residual ink 230, from a broad array of potential cleaner roller surface materials that could not be effectively cleaned without a presence in activation of any release layer in the manner described. As noted above, the cleaner roller 220 normally needs to have a mirror finish to enable web cleaning. Observations have been made through experimentation that use of a release layer can enable effective cleaning even with rougher or scratched surfaces, such as might be expected to develop in use over time in fielded systems.

In implementations, the cleaning web 242 may remain stationary between the supply roller 240 and the used web roller 248 until the cleaning web 242 has accumulated ink to its cleaning capacity. At cleaning capacity, it can be anticipated that cleaned residual products, including the residual ink 230, form a layer on the cleaning web 242 that is thick enough to split and pass through the cleaning web nip rather than remaining trapped in the cleaning web 242. At this point, cleaning of the cleaner roller 220 by the cleaning web 242 may be degraded. The cleaning web 242 may be advanced when the cleaning web 242 reaches a pre-determined cleaning capacity, or preferably just before a cleaning degradation/failure occurs. The cleaning solution or solvent that moistens the release film to aid in cleaning also re-forms the release layer after the cleaning web nip. No additional cleaning solution applicator to the cleaner roller 220 may be needed.

The cleaning solution or solvent preferably consists of a liquid solvent component that may be completely evaporated from the cleaner roller 220 surface prior to entering the cleaning nip with the reimageable surface 215 of the imaging roller 210. If the liquid solvent component of the cleaning solution or solvent is not completely evaporated, the fluid layer on the cleaner roller 220 may adversely affect, or even prevent, transfer of the residual products, including the residual ink 230, from the reimageable surface 215 of the imaging member 210 to the cleaner roller 220. The solid solvent component of the cleaning solution or solvent may be dissolved completely within the liquid solvent component of the cleaning solution or solvent and form a release film that is well adhered to the cleaner roller 220 and does not split due to the adhesive force of the residual products, including the residual ink 230, in the reimageable surface cleaning nip.

It should be noted that, if the residual ink 230, for example, pulls a portion or the entire release film from the cleaner roller 220, the residual ink 230 may have failed to be transferred to the cleaner roller 220 from the reimageable surface 215 of the imaging member 210. In addition to the failure to clean, the release film may have now been transferred to the reimageable surface 215 where it can potentially contaminate the new ink and the reimageable surface 215. Since the printing process relies on the adhesion of new ink to the reimageable surface 215, reduction in adhesion by the presence of a moistened release film could require cleaning of the reimageable surface to remove the release film. Additional desirable cleaning solution attributes are low cost and low environmental impact.

In experimentation, good cleaning performance has been demonstrated with a number of cleaning solutions or solvent liquid solvent components on a number of proposed cleaner roller surface materials. The preferred liquid solvent component has determined at this point to be water. Other solvents would also be expected to work, but water is low cost and environmentally benign. Surfactants have been added to the water to improve wetting on some of the number of proposed cleaner roller surface materials, but further testing has shown that the surfactant is not necessary, at least in most cases.

In experiments, an array of solid solvent components have been tested that were readily available for quick demonstrations and included salt, baking soda, Alconox and borax. Very good cleaning was obtained from all of these solutes as release films. Borax is currently preferred due to good wetting, low cost and low environmental impact, but other solutes are certainly possible.

The cleaning solution aids cleaning by hydrating the release film between the residual products, including the residual ink and the cleaner roller surface. In experiments, a borax release film was applied by moistening a cleaning web with two drops of a borax and water solution prior to passing across a glass surface representing a surface of the cleaner roller. The thin cleaning solution film was allowed to air dry, which took less than one half minute. An ink layer was applied to the dried cleaning solution film. A cleaning solution moistened web was passed over approximately half of the ink layer. This resulted in regions of ink having been cleaned by the web, not yet cleaned by the web and about to be cleaned at the lead edge of web. An adhesive tape was applied to the experimental glass surface, and ink was transferred to the adhesive tape across these regions. The ink remaining on the glass surface after the tape transfer showed a lower density region adjacent to the nip that corresponds to the high density region on the tape transfer, i.e., more ink transferred to the tape near the lead edge of the web than in the region further in front of the web. The experiments demonstrated that the rehydrated release layer reduced ink adhesion ahead of the experimental cleaning web. Prior to the tape transfer, the entire ink stripe ahead of the cleaning web was of uniform density and showed no sign of cleaning solution migration under the ink layer.

The observed reduced adhesion region also occurs when the web is moistened with water alone and no release film is used. This indicates that the cleaning mechanism is similar although the data shows that the release film is more effective in reducing ink adhesion.

The observed better cleaning performance with release films is even more pronounced with a hard to clean surface. For example, when ink is applied to a mylar surface, a water-only moistened web removes very little ink. There is some smearing of ink, but little of the ink even transfers to the cleaning web. If the mylar surface is coated with a borax release layer, then it can be cleaned with a moistened cleaning web.

Excellent cleaning with a cleaning web preferably occurs on a cleaner roller with a mirror smooth surface (~0.01 μm Ra). Any roughness or scratches on the cleaner roller surface tend to prevent the transfer of ink to the cleaning web. Very fine scratches on the cleaner roller are to be expected over time as the cleaner roller wears in use. The application of a cleaning release film to such a surface (Ra=0.06 μm) has been observed to allow cleaning of surfaces that could not be cleaned well without the release film. This is especially evident if thicker release films are applied by using a higher concentration of the solid solvent component in the cleaning solution or solvent.

Exemplary embodiments allow a force required to move the cleaning web across the glass plate being cleaned to be reduced. High web drag forces with lower amounts of cleaning solution were presumed to be due to higher ink adhesion with less rehydration of the release layer. If cleaning is attempted with a dry web, the cleaning web may typically be torn from the web holder by the high ink adhesive forces.

Figure 3:
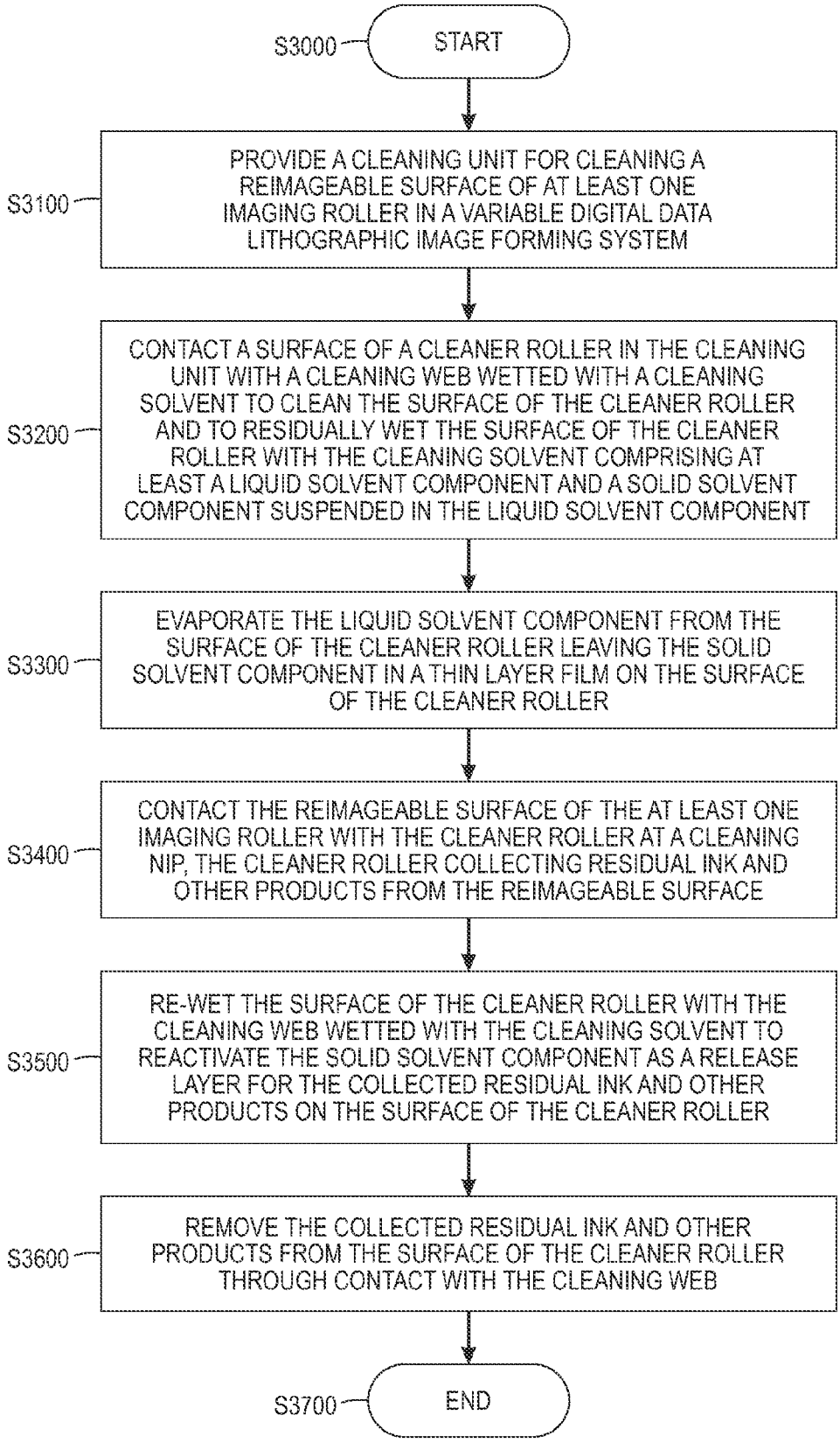
FIG. 3 illustrates a flowchart of an exemplary cleaning process for reimageable surface cleaning in a proposed variable data digital lithographic image forming system according to this disclosure.

The disclosed embodiments may include an exemplary cleaning process for reimageable surface cleaning in a proposed variable data digital lithographic image forming system. FIG. 3 illustrates a flowchart of such an exemplary method. As shown in FIG. 3, operation of the method commences at Step S3000 and proceeds to Step S3100.

In Step S3100, a cleaning unit for cleaning a reimageable surface of at least one imaging roller in a variable digital data lithographic image forming system may be provided. Operation of the method proceeds to Step S3200.

In Step S3200, a surface of a cleaner roller in the cleaning unit may be contacted with a cleaning web. The cleaning web may be wetted with a cleaning solvent to clean a surface of the cleaner roller, and to separately residually wet the surface of the cleaner roller with the cleaning solvent. The cleaning solvent may include at least a liquid solvent component and a solid solvent component suspended in the liquid solvent component, as described above. Operation of the method proceeds to Step S3300.

In Step S3300, the liquid solvent component may be evaporated from the surface of the cleaner roller using a drying component such as an air knife, or simply air drying the surface depending on a composition of the liquid solvent component. This evaporation may leave a thin layer film of the solid solvent component on the surface of the cleaner roller. Operation of the method proceeds to Step S3400.

In Step S3400, the reimageable surface of the at least one imaging roller may be contacted with the cleaner roller coated with the thin layer film of the solid solvent component at a cleaning nip. Exiting the cleaning nip, the cleaner roller may have collected residual ink and other products from the reimageable surface. Operation of the method proceeds to Step S3500.

In Step S3500, the surface of the cleaner roller may be re-wetted with the cleaning solvent to reactivate the solid solvent component as the release layer for the collected residual ink and other products on the surface of the cleaner roller. Operation of the method proceeds to Step S3600.

In Step S3600, the collected residual ink and other products may be removed from the surface of the cleaner roller through contact with the cleaning web. Operation of the method proceeds to Step S3700, where operation of the method ceases.

The above-described exemplary systems and methods may reference certain conventional lithographic image forming device components to provide a brief, background description of image forming means that may be modified to carry out variable data digital lithographic image forming for images which include, at least in part, advanced surface cleaning techniques as described in detail above. No particular limitation to a specific configuration of the variable data digital lithography portions or modules of an overall variable data digital lithographic image forming system is to be construed based on the description of the exemplary elements depicted and described above.

Those skilled in the art will appreciate that other embodiments of the disclosed subject matter may be practiced with many types of image forming elements common to lithographic image forming systems in many different configurations. As mentioned briefly above, experimental cleaning units have taken on numerous different configurations. The disclosed systems and methods are directed to a broad configuration of such cleaning units and are not intended to imply any potentially limiting configuration based on the above description and the accompanying drawings.

The exemplary depicted sequence of executable method steps represents one example of a corresponding sequence of acts for implementing the functions described in the steps. The exemplary depicted steps may be executed in any reasonable order to carry into effect the objectives of the disclosed embodiments. No particular order to the disclosed steps of the method is necessarily implied by the depiction in FIG. 3, and the accompanying description, except where a particular method step is reasonably considered to be a necessary precondition to execution of any other method step. Individual method steps may be carried out in sequence or in parallel in simultaneous or near simultaneous timing. Additionally, not all of the depicted and described method steps need to be included in any particular scheme according to this disclosure.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

I claim:

1. A method for cleaning a reimageable surface in a variable data digital image forming system, comprising:

providing a cleaner roller for contacting a reimageable surface of an imaging member in a variable data digital image forming system at a cleaner nip;

wetting a cleaning surface component for separately cleaning the cleaner roller with a solvent, the solvent including a liquid component and a solid component suspended in the liquid component, contacting a surface of the cleaner roller with the wetted cleaning surface component at a cleaning nip between the cleaning surface component and the surface of the cleaner roller, the cleaning surface component leaving a layer of the solvent on the surface of the cleaner roller;

evaporating the liquid component of the solvent prior to the surface of the cleaner roller contacting the reimageable surface at the cleaner nip leaving a release layer formed of the solid component of the solvent on the surface of the cleaner roller;

removing ink from the reimageable surface through contact of the reimageable surface with the cleaner roller at the cleaner nip;

re-wetting the release layer on the surface of the cleaner roller with the cleaning surface component after the surface of the cleaner roller passes through the cleaner nip collecting the ink from the reimageable surface to facilitate the removal of the ink from the surface of the cleaner roller; and cleaning the surface of the cleaner roller via contact with the cleaning surface component.

2. The method of claim 1, the liquid component of the solvent being self-evaporating.

3. The method of claim 1, further comprising employing an evaporator device positioned downstream in a process direction of a position where the cleaning surface component contacts the surface of the cleaner roller to actively evaporate the liquid component of the solvent.

4. The method of claim 3, the evaporator device being an air knife.

5. The method of claim 1, the cleaner roller having a smooth hard surface.

6. The method of claim 1, the cleaning surface component comprising a web material that is threaded from a supply roller around a pressure roller at a cleaning nip between the web material and the cleaner roller and to a take up roller.

7. The method of claim 1, the cleaning surface component comprising a sponge surface on a roller component.

8. The method of claim 1, the liquid component of the solvent being water.

9. The method of claim 1, the solid component of the solvent being at least one of borax, salt, baking soda and Alconox®.

* * * * *